US007523703B2

(12) United States Patent
Holm

(10) Patent No.: US 7,523,703 B2
(45) **Date of Patent: *Apr. 28, 2009**

(54) PRINTING GROUP OF A ROTARY PRINTING PRESS

(75) Inventor: Helmut Holm, Erlabrunn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 171 days.

This patent is subject to a terminal disclaimer.

(21) Appl. No.: 11/338,845

(22) Filed: Jan. 25, 2006

(65) Prior Publication Data

US 2006/0117974 A1 Jun. 8, 2006

Related U.S. Application Data

(60) Continuation of application No. 11/070,245, filed on Mar. 3, 2005, now Pat. No. 7,066,090, which is a division of application No. 10/111,417, filed as application No. PCT/DE00/04293 on Dec. 1, 2000, now Pat. No. 6,920,824.

(30) Foreign Application Priority Data

| | | |
|---|---|---|
| Apr. 1, 2000 | (DE) | 100 16 409 |
| Dec. 2, 2002 | (DE) | 199 58 133 |
| Dec. 2, 2002 | (DE) | 199 58 135 |

(51) Int. Cl.
*B41F 7/12* (2006.01)

(52) U.S. Cl. ..... 101/375; 101/376; 101/380; 101/382.1; 101/415.1; 101/217

(58) Field of Classification Search ..... 101/216, 101/401.1, 415.1, 375, 382.1, 380, 383, 378, 101/386, 142, 217, 376
See application file for complete search history.

(56) References Cited

U.S. PATENT DOCUMENTS

| | | | | |
|---|---|---|---|---|
| 1,733,707 A | | 10/1929 | Wood | |
| 2,243,195 A | | 5/1941 | Crafts | |
| 2,768,578 A | * | 10/1956 | Park et al. | 101/415.1 |
| 3,335,663 A | | 8/1967 | Harenza | |

(Continued)

FOREIGN PATENT DOCUMENTS

DE 441812 3/1927

(Continued)

OTHER PUBLICATIONS

Newspaper Techniques-Sep. 1991- "Six-Wide Newspaper Pressed-History and Facts".

(Continued)

*Primary Examiner*—Anthony H Nguyen
*Assistant Examiner*—Leo T Hinze
(74) *Attorney, Agent, or Firm*—Jones, Tullar & Cooper, P.C.

(57) ABSTRACT

A printing group of a rotary printing press includes at least one forme cylinder and at least one transfer cylinder. The forme cylinder has at least two printing forme end channels. These two channels are spaced circumferentially. At least one of these forme cylinder end receiving channels rolls off against a channel in the transfer cylinder. One of the forme cylinder end receiving channels is at least partially covered by a printing forme carried by the forme cylinder.

15 Claims, 5 Drawing Sheets

U.S. PATENT DOCUMENTS

| | | | | | |
|---|---|---|---|---|---|
| 3,540,723 | A | | 11/1970 | Bolza-Schunemann | |
| 3,824,928 | A | | 7/1974 | Langer | |
| 3,893,394 | A | | 7/1975 | Fusco et al. | |
| 3,942,782 | A | | 3/1976 | Hermach | |
| 3,945,788 | A | | 3/1976 | Inoue et al. | |
| 3,983,811 | A | | 10/1976 | Fuchs et al. | |
| 4,079,928 | A | | 3/1978 | Weschenfelder et al. | |
| 4,207,815 | A | | 6/1980 | Watanabe | |
| 4,337,700 | A | | 7/1982 | Etchell et al. | |
| 4,347,788 | A | | 9/1982 | Dufour et al. | |
| 4,557,196 | A | | 12/1985 | Kobler | |
| 4,635,550 | A | | 1/1987 | Brands et al. | |
| 4,790,245 | A | | 12/1988 | Fischer et al. | |
| 4,794,856 | A | | 1/1989 | Giori | |
| 4,817,527 | A | | 4/1989 | Wouch et al. | |
| 4,907,508 | A | | 3/1990 | Patschorke | |
| 5,069,127 | A | * | 12/1991 | Iijima et al. | 101/415.1 |
| 5,245,923 | A | | 9/1993 | Vrotacoe | |
| 5,419,248 | A | | 5/1995 | Brotzman | |
| 5,473,983 | A | | 12/1995 | Maul | |
| 5,575,208 | A | | 11/1996 | Kirihara | |
| 5,590,597 | A | | 1/1997 | Balow | |
| 5,687,648 | A | | 11/1997 | Puschnerat | |
| 5,749,298 | A | | 5/1998 | Castelli et al. | |
| 5,778,779 | A | | 7/1998 | Jones et al. | |
| 5,778,787 | A | | 7/1998 | Stiel | |
| 5,787,812 | A | | 8/1998 | Shoji | |
| 6,116,159 | A | | 9/2000 | Koyama | |
| 6,374,731 | B1 | | 4/2002 | Walczak et al. | |
| 6,408,747 | B2 | | 6/2002 | Koppelkamm et al. | |
| 6,631,677 | B1 | | 10/2003 | Fuhrmann et al. | |
| 6,920,824 | B2 | * | 7/2005 | Holm | 101/217 |
| 7,066,090 | B2 | * | 6/2006 | Holm | 101/375 |
| 7,246,557 | B2 | * | 7/2007 | Holm | 101/375 |

FOREIGN PATENT DOCUMENTS

| | | | |
|---|---|---|---|
| DE | 1960635 | | 6/1971 |
| DE | 2528008 | | 1/1976 |
| DE | 2701670 | | 7/1978 |
| DE | 2948488 | A1 | 6/1981 |
| DE | 3441175 | A1 | 5/1986 |
| DE | 3441175 | C2 | 1/1987 |
| DE | 4320923 | B4 | 1/1994 |
| DE | 4444062 | | 9/1995 |
| DE | 4429210 | A1 | 2/1996 |
| DE | 4429891 | A1 | 2/1996 |
| DE | 19541249 | | 11/1996 |
| DE | 19740475 | A1 | 3/1999 |
| DE | 19803809 | A1 | 8/1999 |
| DE | 179219 | | 11/2004 |
| EP | 0170956 | A2 | 2/1986 |
| EP | 0235677 | A2 | 9/1987 |
| EP | 0317656 | A1 | 5/1989 |
| EP | 0849080 | B1 | 11/2000 |
| FR | 511725 | | 1/1921 |
| GB | 1476707 | | 6/1977 |
| GB | 2092069 | | 8/1982 |
| GB | 2273464 | A | 6/1994 |
| JP | 1071694 | | 3/1998 |

OTHER PUBLICATIONS

Newspaper Techniques-Oct. 1991- "KBA Journal, a "Little Sister" for the Commander and Express".

Fuchs, Boris, "Wie viele Platten pro Zylinder?," zeitungstechnik, Jan. 2000.

Fuchs, Boris, "Single and double width vs. single and double circumference," newspaper techniques, Jan. 2000.

Man Roland, "Geoman, The innovative GEOMAN—70,000 Copies Per Hour," E12.

Koenig & Bauer-Albert, "Journal, An economical newspaper web offset press for small and medium runs," (vol. E11).

Koenig & Bauer-Albert, "Journal, Die wirtschaftliche Rollenoffsetmaschine fur kleinere und mittlere Zeitungsauflagen," (vol. E13).

Koenig & Bauer-Albert, "The economical web offset newspaper press for small and medium circulations," (English language version of Keonig & Bauer-Albert E13 document).

* cited by examiner

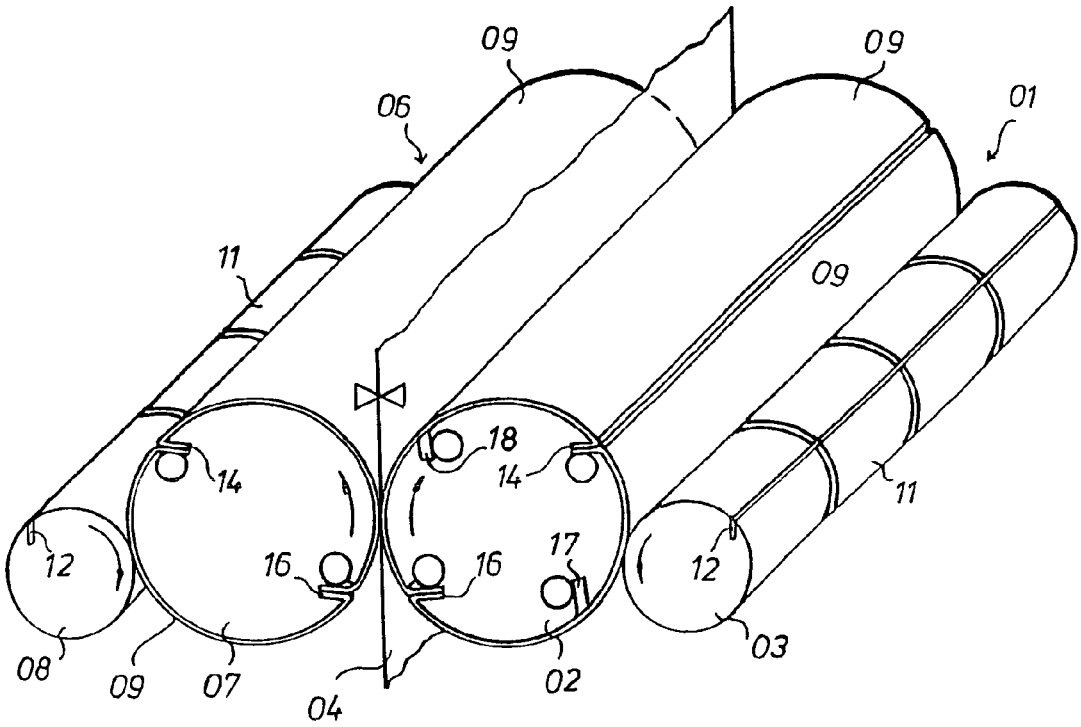
Fig. 7
Fig. 8
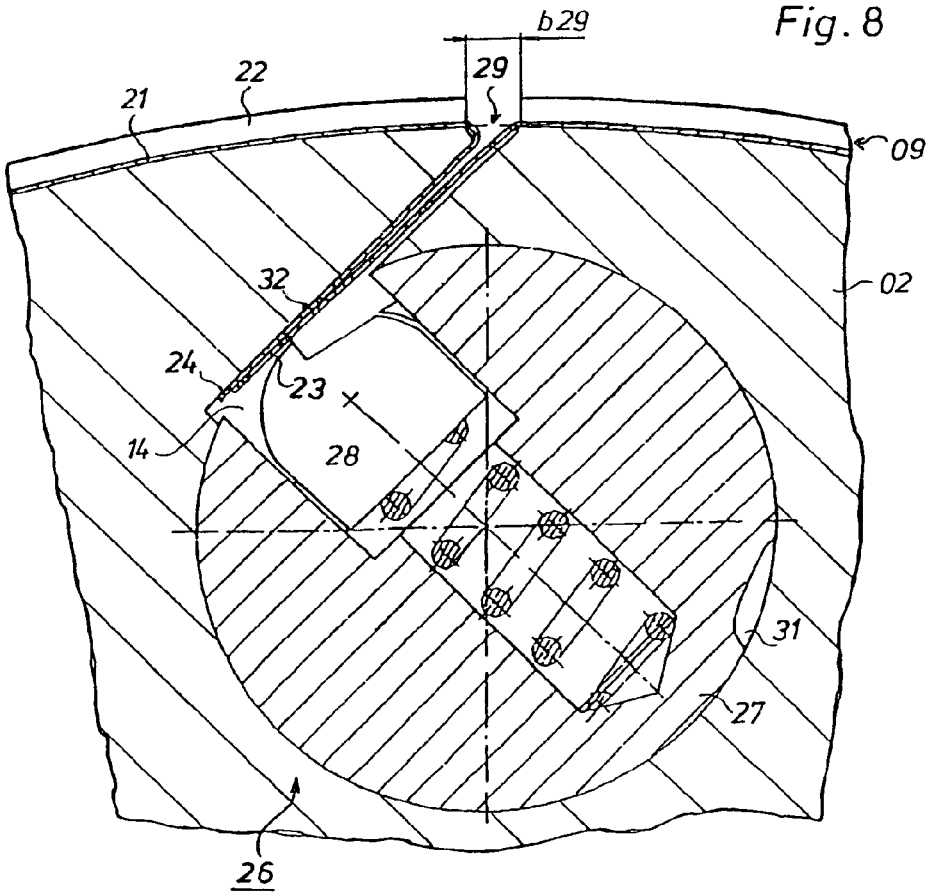

PRINTING GROUP OF A ROTARY PRINTING PRESS

CROSS-REFERENCE TO RELATED APPLICATIONS

This U.S. patent application is a continuation of U.S. patent application Ser. No. 11/070,245, filed Mar. 3, 2005, now U.S. Pat. No. 7,066,090 issued Jun. 27, 2006. That patent is a division of U.S. patent application Ser. No. 10/111,417, filed May 7, 2002, now U.S. Pat. No. 6,920,824, issued Jul. 26, 2005. That patent is the U.S. national phase of PCT/DE00/04293, filed Dec. 1, 2000, published as WO 01/39977A1 on Jun. 7, 2001 and claiming priority to DE 199 58 133.9, filed Dec. 2, 2002; to DE 199 58 135.5, filed Dec. 2, 2002, and to DE 100 16 409.9, filed Apr, 1, 2000, the disclosures of which are expressly incorporated herein by reference.

FIELD OF THE INVENTION

The present invention is directed to a printing group of a rotary printing press. The printing group includes at lest one forme cylinder and at least one transfer cylinder. These cylinders have axially extending, circumferentially spaced surface grooves.

BACKGROUND OF THE INVENTION

An arrangement of four printing foils or formes, one behind the other in the direction of rotation of the forme cylinder, which four printing foils or formes are maintained in four pits or grooves, is known from DE 44 29 210 A1. Each of the printing foils or formes spans a section of an arc of a circle located between two pits or grooves.

DE 44 29 891 A1 shows a printing group of a rotary printing press with a double-sized transfer cylinder; i.e. one with two section lengths over the circumference, which works together with a single-sized forme cylinder.

The arrangement of cylinders of an offset printing group is also known from DE 198 03 809 A1, wherein the circumference of the transfer cylinder is at a ratio of twice that of the forme cylinder. The forme cylinder can be occupied by one printing forme in the circumferential direction, and in its longitudinal direction, by at least four vertical print pages in a broadsheet format, or a corresponding number of vertical or horizontal tabloid or book formats. A single slit, which is either continuous in the longitudinal direction, or is divided in the longitudinal direction and offset by 180°, is arranged in the circumferential direction of the transfer cylinder for receiving two blankets, which are arranged next to each other in the longitudinal direction of the cylinder. The blanket is designed, for example, in two layers as a rubber blanket fastened on a support plate.

Recesses in the cylinder surface of the transfer cylinder are proposed, in DE 34 41 175 C2, for the purpose of relaxing the rubber blanket. For this purpose, it is also possible to arrange a backing between the cylinder and the rubber blanket, which backing does not extend in the circumferential direction over the entire length of the rubber blanket and has a gap. An insertion slit for receiving the discontinuous backing is arranged on the circumference of the cylinder next to the bracing groove for the rubber blanket. The recesses arranged in the longitudinal direction of the transfer cylinder, and the groove receiving the rubber blanket, are arranged in such a way that in the contact area they respectively work together with the groove of the plate cylinder.

DE 197 40 575 A1 shows forme and transfer cylinders, which work together, wherein the transfer cylinders in one preferred embodiment have two bracing grooves located one behind the other and two rubber blankets maintained in the bracing grooves. In another example, a double-sized transfer cylinder acts together with a double-sized forme cylinder wherein, however, both cylinders have only one bracing groove in the circumferential direction. In all of these examples, the grooves do not roll off on each other.

A single forme cylinder is known from DE-OS 19 60 635, which, in the circumferential direction, has several grooves for fastening printing formes on its circumference. At least one of the grooves can be covered when placing a printing forme on the forme cylinder in the circumferential direction.

SUMMARY OF THE INVENTION

The object of the present invention is based on providing a printing group of a rotary printing press.

In accordance with the present invention, this object is attained by providing a printing group of a rotary printing press with at least one transfer cylinder and at least one forme cylinder. The transfer cylinder has at least one blanket edge receiving groove. The forme cylinder has at least two axially extending, circumferentially spaced grooves. At least one of the forme cylinder grooves is at least partially covered by a printing forme during press operation. This partially covered groove rolls off a groove in the cooperating transfer cylinder.

The advantages to be obtained by the present invention lie, in particular, in that a flexible employment of several dressing or covering formats is possible. When using dressings or coverings of large circumferential lengths, a pressure relief in the areas of grooves, in particular in the area of grooves covered by dressings, is assured at the same time, as well as the highest possible print quality in the course of unwinding or forming the printed image.

The arrangement of several grooves, each extending in the longitudinal or axial direction of the forme and/or transfer cylinder, meets the most diverse conditions as required. It is thus not necessary to exchange the cylinder in case of varying demands made on existing printing presses, or to consider every demanded profile individually during the manufacturing process.

It is particularly advantageous, in accordance with the present invention, that it is possible to take into consideration different formats of the dressings or coverings in the circumferential and longitudinal direction, as well as different groupings and phase shifts of the cylinders which work together in a reciprocal manner. In this way these formats can be optimized in respect to the demands, some of which are in conflict with each other, regarding maintaining the registration, low vibration, arrangement of the printing areas rolling off on each other, and minimizing paper which cannot be imprinted.

A preferred embodiment of a forme cylinder with double circumference, i.e. for example two newspaper pages in the circumferential direction, allows the selective placement of printing formes arranged one behind the other in the circumferential direction, or of printing formes extending over the entire circumference, in which case a groove is covered. The arrangement of printing formes extending over the full circumference considerably reduces the change-over time, for example. In case of a transfer cylinder, an arrangement of blankets extending over the full circumference considerably reduces the change-over time.

By arranging at least two grooves, which are almost continuous in the longitudinal direction, on a transfer cylinder, a multitude of options for arranging dressings or coverings, for example blankets, is created. With the arrangement of several grooves, it is also advantageous, in view of the quality of the unwinding or rolling-off of the printed image, in comparison with cylinders of twice the size but with only one groove, that a covered groove can simultaneously be used for relaxing the dressing or covering in the case of blankets extending over the entire circumference.

The arrangement of a single dressing or covering extending in the longitudinal and circumferential direction results in advantages regarding the multitude of printable formats, such as height and width of the printed areas, for example in the situation of a panorama.

When covering a groove by a printing forme, it is advantageous, for reasons of the danger of a break, to arrange the forme cylinder and transfer cylinder in such a way that the covered groove of the forme cylinder rolls off on a groove of the transfer cylinder. The roll-off of a groove of the transfer cylinder, covered by a blanket, on a groove of the forme cylinder is also advantageous in view of a further improved relaxation of the blanket in the course of the passage of the grooves over each other, and therefore for the rolled-off or formed printed image.

The arrangement of several dressings or coverings, which are arranged next to each other in the longitudinal direction of the cylinder, and each of which extends almost over the entire circumference, has advantages, for example, in view of their handling and individual replacement capability. This applies, in particular, for long cylinders, such as is the case for double-width, for example, four newspaper pages in the longitudinal direction of the cylinder or even triple-width, for example six newspaper pages cylinders.

Regarding the quality of unwinding or rolling-off of the printed image, the embodiment of the dressings for the transfer cylinder is also advantageous in the form of multi-layered or multi-ply blanket, which has a support plate and a cover, or layer, connected with the latter. With large dimensions in particular, an embodiment, which is as dimensionally stable as possible, is essential for a consistently good and exactly registered printing quality over the circumference of the cylinder.

An embodiment of the grooves with a narrow opening toward the outer or shell surface of the cylinder is also advantageous, for example, in view of reducing paper consumption. A narrow opening is particularly advantageous for grooves in the forme cylinder, in particular for grooves which are at least partially covered. For example, it is possible because of this to further reduce the breaking danger.

It is moreover advantageous to make the circumferential ratio of the transfer cylinder in respect to the forme cylinder as a whole number and to arrange the grooves symmetrically in the circumferential direction on the cylinder.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
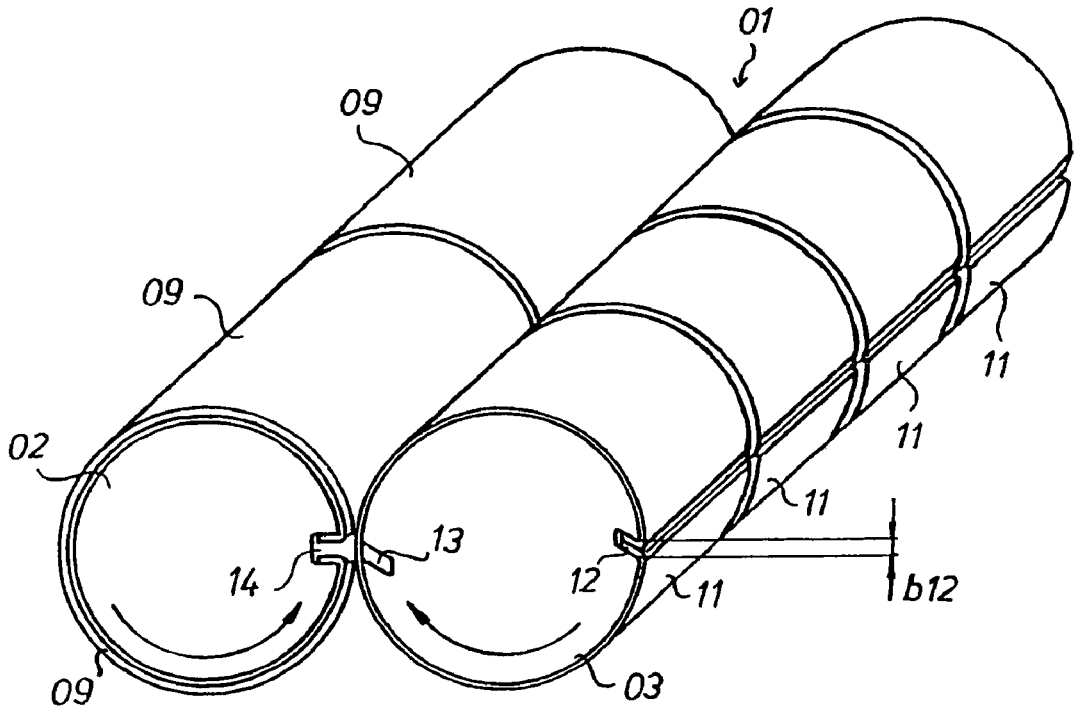
FIG. 1, a schematic perspective view of a pair of double-width cylinders, in which the forme cylinder has two grooves extending in the longitudinal direction, and the dressings or coverings extend over almost the complete circumference of the forme cylinder, FIG. 2, a pair of double-width cylinders, in which the forme and the transfer cylinders are each formed with two grooves extending in the longitudinal direction, and the dressings or coverings extend over almost the complete circumference of the forme and transfer cylinder, FIG. 3, two pairs of double-width cylinders, in which the transfer cylinder in each pair is formed with two grooves extending in the longitudinal direction and is equipped with two dressings or coverings extending over almost the entire circumference, which coverings are located next to each other in the longitudinal direction, FIG. 4, two pairs of double-width cylinders, in which the transfer cylinder in each pair is formed with two grooves extending in the longitudinal direction and is equipped with two dressings or coverings extending over almost the entire circumference, which are located next to each other in the longitudinal direction, but are offset by 180° in the circumferential direction, FIG. 5, two pairs of double-width cylinders, in which the transfer cylinder in each pair is formed with two grooves extending in the longitudinal direction and is equipped with two dressings or coverings extending over almost the entire length of the barrel, which are located one behind the other in the circumferential direction, FIG. 6, two pairs of double-width cylinders, in which the transfer cylinder in each pair is formed with two grooves extending in the longitudinal direction and has four dressings, wherein respectively two dressings or coverings arranged one behind the other in the circumferential direction are arranged next to each other in the longitudinal direction, FIG. 7, two pairs of double-width cylinders, in which the transfer cylinder in each pair is formed with four grooves, each extending in the longitudinal direction, and is equipped with two dressings or coverings extending over almost the entire length of the barrel, which are located one behind the other in the circumferential direction, in FIG. 8, a multi-layer blanket with a groove and holding device.
Figure 3:
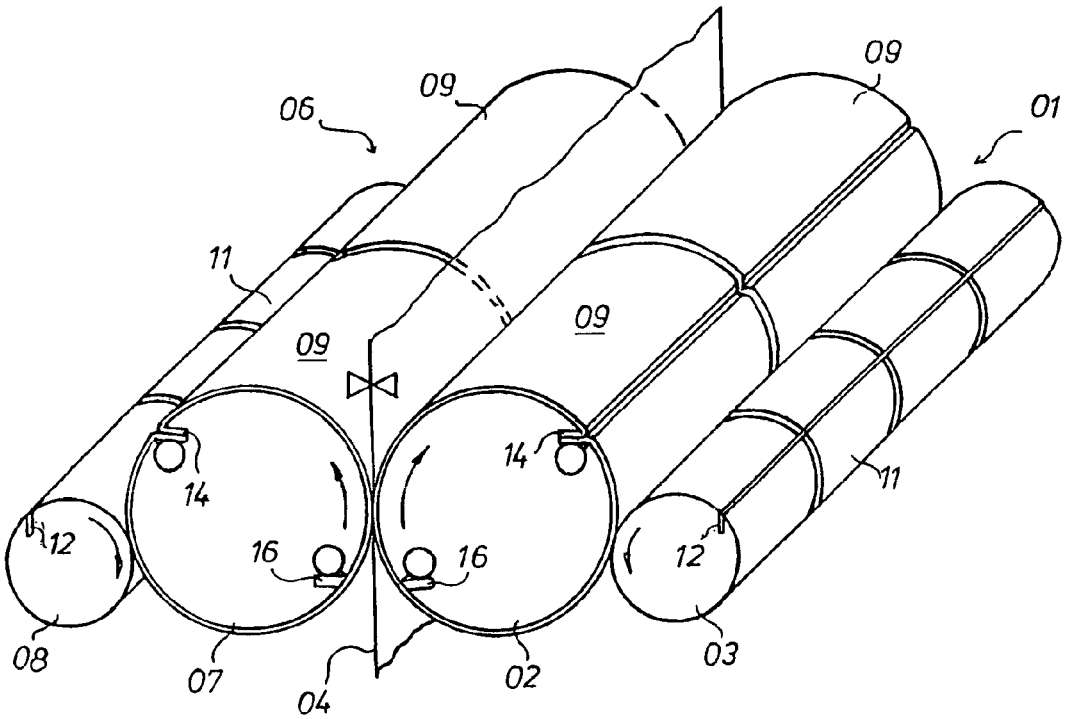
Figure 4:
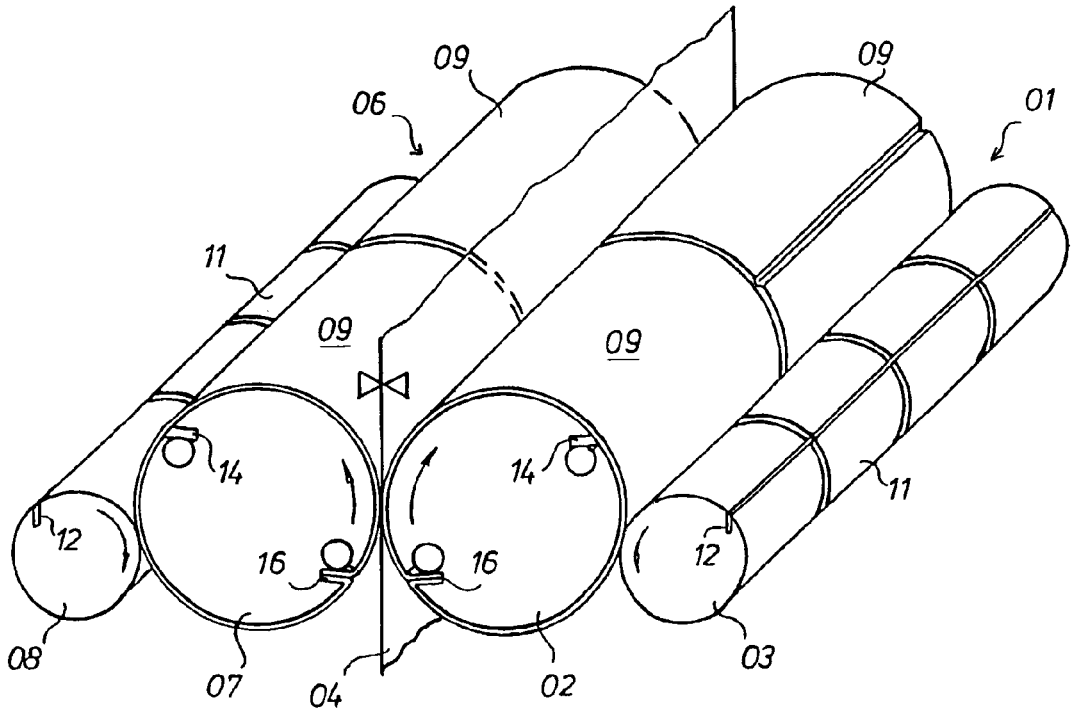
Figure 9:
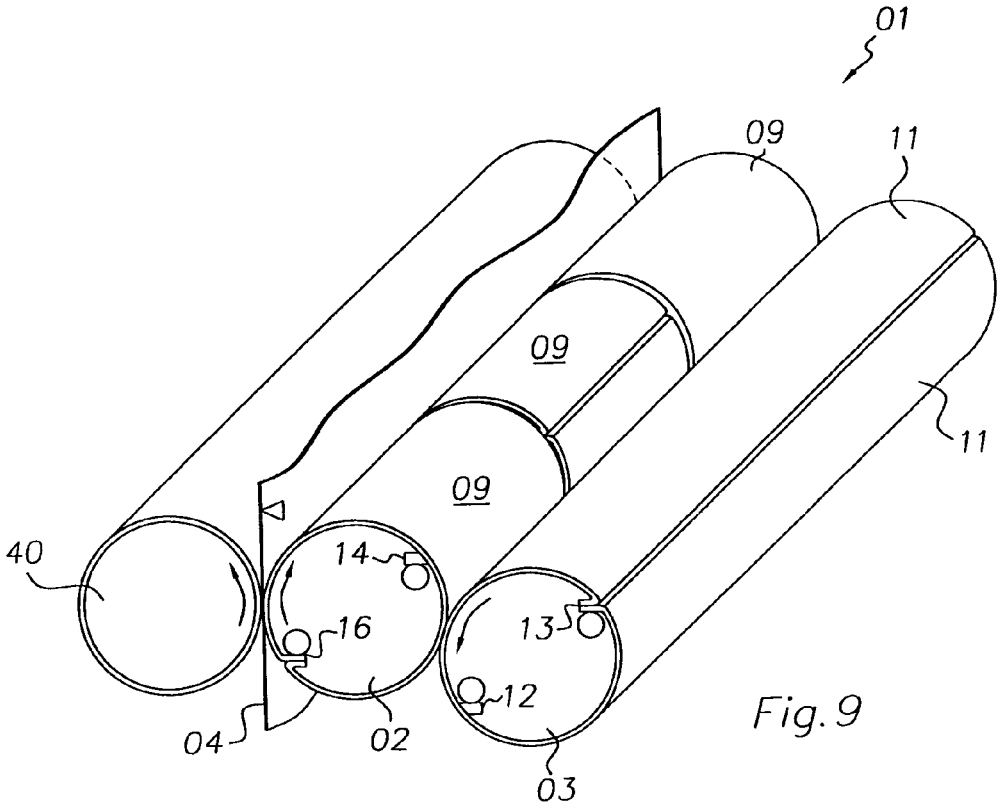
FIG. 9, a pair of triple-width cylinders with a cooperating counter-pressure cylinder in which the forme cylinder is formed with two grooves extending in the longitudinal direction and the transfer cylinder has three blankets offset from each other in axial direction; and in FIG. 10, two pairs of triple-width cylinders in which the transfer cylinder in each pair is formed with two grooves extending in the longitudinal direction and is equipped with one dressing or covering extending over almost the entire circumference in which each forme cylinder has two grooves extending in the longitudinal direction over the length of the forme cylinder which is six newspaper pages in width and has a circumferential length of two upright newspapers pages.

A printing group of a rotary printing press is shown in FIG. 1 and has at least one cylinder pair 01, consisting of two cylinder 02, 03, for example a transfer cylinder 02 and a forme cylinder 03 acting together with it. Via the material 04 to be imprinted, which material 04 can be seen in FIG. 3 and FIG. 9 for example, the transfer cylinder 02 can act together with a counter-pressure cylinder, which is represented in FIG. 9 at 40, or with a transfer cylinder 07, also as seen in FIG. 3, to which a forme cylinder 08, of a second cylinder pair 06, is assigned. The transfer cylinders 02, 07 can each be equipped with at least one dressing or covering 09, for example a blanket 09, and the forme cylinders 03, 08 each can also be equipped with at least one dressing or covering 11, for example a printing forme 11.

Depending on the demands made on the printing formats and the printing output, as well as various possibilities regarding the paper guidance, the cylinder pairs 01, 06 of FIGS. 1, 2, 9 and FIGS. 3, 7 and 10 respectively are embodied to be of various widths. For example, the cylinder pairs 01, 06 for printing newspapers can be of single, double or triple width, wherein single width identifies the width of the barrel, for example that of the forme cylinder 03, for two vertical or horizontal newspaper pages. In connection with job printing, double width identifies the width required for four horizontal or six vertical A4 pages. The circumferences of the transfer cylinders 02, 07 and of the forme cylinders 03, 08, are respectively of single or double length or height in relation to the most varied vertical or horizontal formats, for example a vertical or a horizontal newspaper format. Advantageous groupings in connection with newspaper printing are, for example, a double length circumference, i.e. two pages in the circumferential direction, of the transfer cylinder 02, 07, acting together with a double or single circumference of the forme cylinder 03, 08, each of double width. A triple width format is shown in FIG. 9 in which the cylinder pair 01 are used for printing newspapers of six newspaper pages in width. The two cylinders both have a double circumference.

FIG. 1 shows a double-width cylinder pair 01, wherein the transfer cylinder 02 and the forme cylinder 03 each also have a double circumference. The forme cylinder 03 has two grooves 12, 13, each extending in the longitudinal direction and spaced apart from each other in the circumferential direction of the forme cylinder 03. Each groove 12, 13 is provided for receiving the ends of at least one printing forme 11. The transfer cylinder 02 has a groove 14 for receiving the ends of at least one blanket 09. The grooves 12, 13 of the forme cylinder 03, 08 are arranged, at least over a partial section of the forme cylinder in the longitudinal direction of the forme cylinder 03, 08, spaced from each other in the circumferential direction, viewed in a cross section extending perpendicular in respect to the axis of rotation. In the configuration shown in FIG. 1, the forme cylinder 03 is equipped with four printing formes 11, for example printing plates 11, arranged next to each other in the longitudinal direction of the cylinder, whose respective two ends are maintained in the groove 12. Each printing forme 11 extends over the entire circumference of cylinder 03, except for the area of the groove 12, and each forme 11 is covering over the groove 13. To prevent the danger of breaking, in an advantageous manner the forme cylinder 03 and the transfer cylinder 02 are arranged with respect to each other in such a way that, in the course of rolling off of the transfer cylinder 02 and the forme cylinder 03 with respect to each other, the covered groove 13 of the printing forme 03 acts together with the groove 14 of the transfer cylinder 02. The latter is not necessary if, for example, the groove 13 can be closed off by, for example, a releasable cover, or if the groove width is so small that a break is avoided. The forme cylinder 03 can be embodied to be of single, double or triple width. A double width is shown in FIG. 1 while a triple width is shown in FIG. 9. It can be flexibly covered in various ways, for example with one continuous, or with two or more printing plates 11 of the most varied formats, for example single or panorama, arranged next to each other in the longitudinal direction. If needed, the forme cylinder 03 can also have more than two grooves 12, 13, which extend in the longitudinal direction and which are spaced apart in the circumferential direction. The transfer cylinder 02 in FIG. 1 can have a sole continuous groove 14, in which two blankets 09 are held next to each other in the axial direction. It is also possible to arrange two grooves 14, 16, which are next to each other in the axial direction, but which are circumferentially offset in respect to each other, for example by 180°. This arrangement of the transfer cylinder is shown in FIG. 9. The blankets arranged next to each other on cylinder 02 are also offset in respect to each other in this arrangement, which is represented in FIG. 9, so that the second, axially offset groove 14 would be covered in FIG. 9 and would not be visible.

Figure 2:
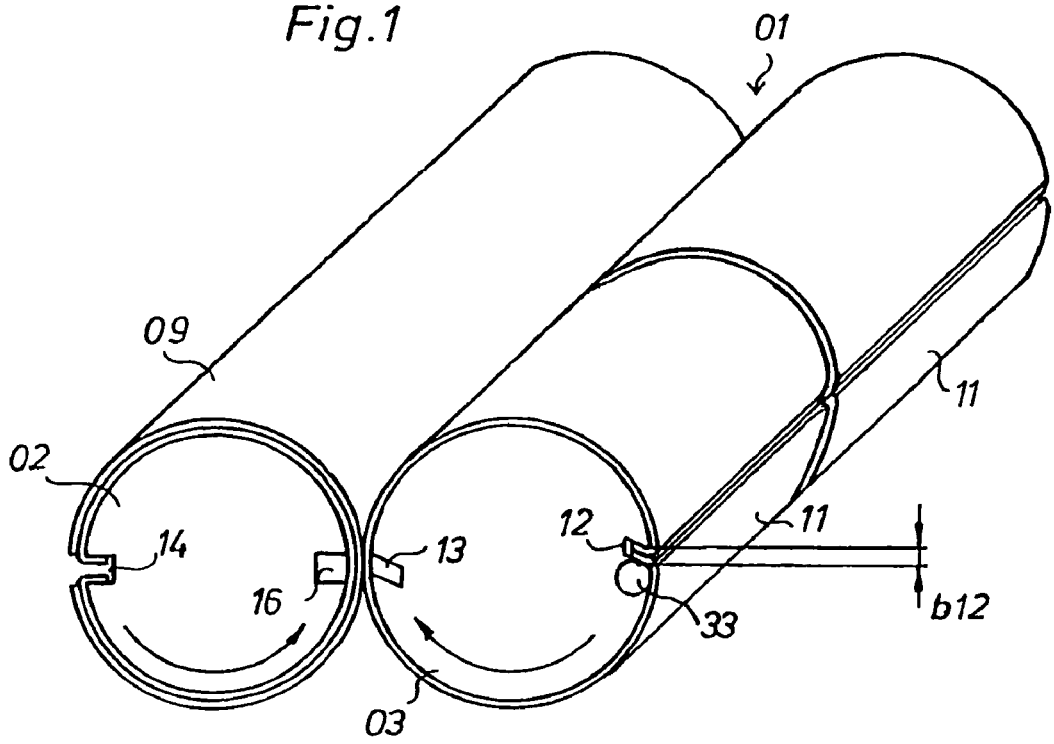

The transfer cylinder 02 can also have a second groove 16 which, for example, lies diametrically opposite the first transfer cylinder groove 14 and which extends in the longitudinal direction of the transfer cylinder 02, as represented by way of example in FIG. 2. The grooves 14, 16 of the transfer cylinder 02 or 07 are arranged, at least over a partial section in the longitudinal direction of the transfer cylinder 02 or 07, behind each other in the circumferential direction, viewed in a cross section extending perpendicular in respect to the axis of rotation. In the example depicted in FIG. 2, a single blanket 09, which extends, as far as the area of the groove 14, over the entire length of the barrel of transfer cylinder 02 and over almost the entire circumference, covers the transfer cylinder 02. By way of example, the forme cylinder 03 in FIG. 2 is covered by two printing plates 11, which lie next to each other in the longitudinal direction of the forme cylinder 03 and each of which extends over almost the entire circumference of cylinder 03. In the example, the covered groove 16 acts together with the also covered groove 13 of the forme cylinder 03. But, as in the first preferred embodiment, it can also roll off on the uncovered groove 14.

Besides the double-width embodiment, represented in FIGS. 1, 2 and 3 of the transfer cylinder 02 or 07, which acts together with the forme cylinder 03, 08, it can also be embodied at a single or triple width, for example. The transfer cylinder 02, 07 in the first two embodiments of FIGS. 1, 2, and 3, which acts together with the forme cylinder 03, 08 having two grooves 12, 13, can, as shown in FIGS. 1 to 7 and their description, by way of example, be equipped flexibly with one continuous blanket 09, with two or more blankets 09, arranged next to each other in the longitudinal direction, or arranged behind each other in the circumferential direction, or with several blankets 09, arranged next to each other in the longitudinal direction and simultaneously with several blankets 09 arranged behind each other in the circumferential direction. In this case, a forme cylinder 03 of double circumference, for example, from FIGS. 1 and 2 and their description, can take the place of the single circumference forme cylinders 03, 08 represented in FIGS. 3 to 7. If required, the transfer cylinder 03 can also have more than two grooves 12, 13 extending in the longitudinal direction and spaced apart in the circumferential direction. A conventionally constructed and equipped transfer cylinder, for example of double width, only one groove, one or two blankets next to each other in the longitudinal direction, or a transfer cylinder of twice the circumference, having two grooves arranged next to each other offset in the axial direction and simultaneously behind each other in the circumferential direction, and which can be covered with two blankets, for example offset in respect to each other in the circumferential and longitudinal direction, can act together with the embodiments of the forme cylinder 03, 08 represented in accordance with FIGS. 1 and 2.

However, it is advantageous for all embodiments of the transfer cylinder 02, 07 acting together with the forme cylinder 03, 08, if the former; i.e. the transfer cylinder 02, 07 has at least one groove 14, 16 in the longitudinal direction, and if the at least partially covered groove 12, 13 of the forme cylinder 03, 08 rolls off on this groove 14, 16.

Figure 10:
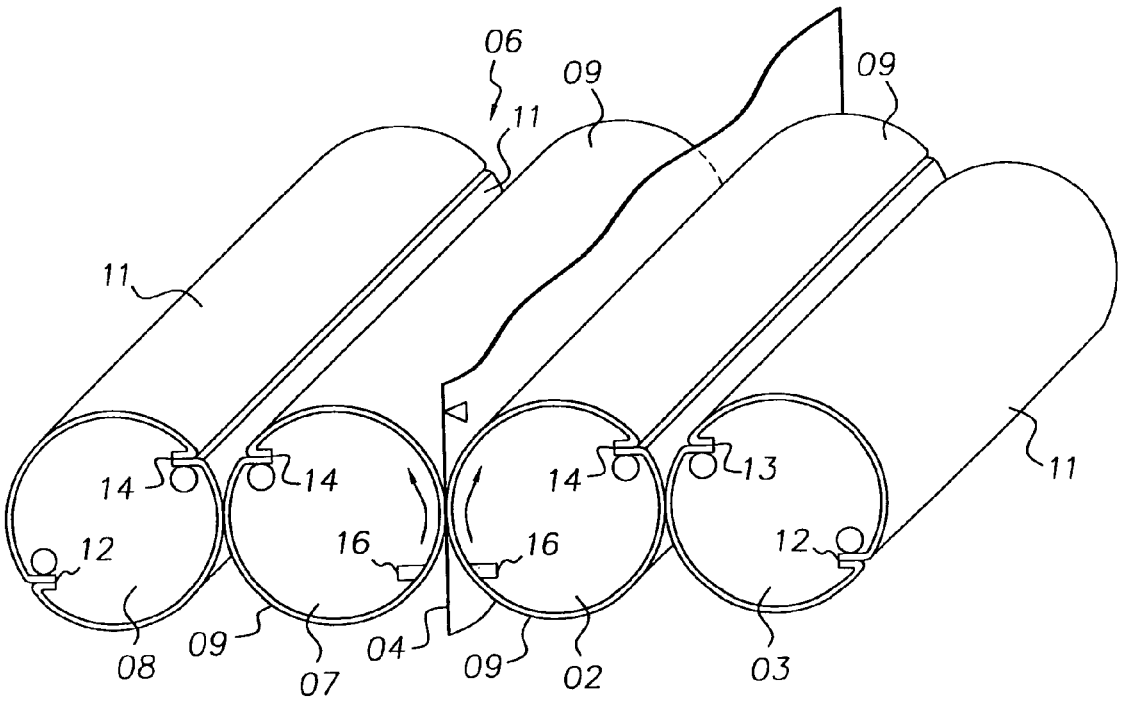

Some further advantageous preferred embodiments for the arrangement of blankets 09 on a transfer cylinder 02, 07 are represented in the subsequent embodiments shown in FIGS. 3-7, and 10 and the associated description, wherein the transfer cylinder 02, 07 has several grooves 14, 16 extending in its longitudinal direction. The examples respectively show two at least double-width cylinder pairs 01, 06 constituting a printing unit, wherein the two transfer cylinders 02, 07 act together with each other via the material 04 to be printed. However, if required, the cylinder pairs 01, 06 can also be embodied to be of single, triple or even quadruple width. A triple width pair is shown in FIG. 10. In this case, the teaching from the examples are to be applied accordingly. In the depicted examples of FIGS. 3-7, the transfer cylinder 02, 07 has a circumference twice the size of that of the forme cylinder 03, 08, which, in these cases, is covered with four printing plates 11, respectively arranged next to each other in the longitudinal direction. However, in the same way, the forme cylinder 03, 08 can also be covered with two panorama printing formes arranged next to each other, or with one panorama printing forme and two single printing formes. However, in connection with all of the following preferred embodiments, the cooperating forme cylinder 03, 08 can also be designed to be twice the depicted size of FIGS. 3-7. Such a configuration is shown in FIG. 10. The forme cylinder 03, 08 can be equipped with one or two grooves 12, 13, with two printing formes 11 arranged next to each other in the axial direction or behind each other in the circumferential direction, or with several printing formes arranged next to each other in the longitudinal direction and simultaneously with several arranged behind each other in the circumferential direction. The embodiments of the forme cylinder 03, 08 represented in FIGS. 1 and 2, acting together with the transfer cylinders 02, 07 of FIGS. 3 to 7 can also be employed.

It is advantageous for all embodiments of the forme cylinder 03, 08 acting together with the transfer cylinder 02, 07 from the preferred embodiments 2 to 4 and 7, if the forme cylinder has at least one groove 12, 13 in the longitudinal direction and the at least partially covered groove 14, 16 of the transfer cylinder 02, 07 rolls off on it.

FIG. 3 shows the arrangement of two blankets 09 on each transfer cylinder 02, 07, which two blankets 09 are arranged next to each other in the longitudinal direction of the transfer cylinder 02, 07 and, each extending over almost the full circumference of its respective transfer cylinder. Two grooves 14, 16 extend in the longitudinal direction of the transfer cylinder 02, 07 and are arranged offset in the circumferential direction by almost 180°. The groove 16 is covered and can counteract flexing, in particular in connection with blankets 09 which are not dimensionally stable, and as a relief unit it can relax the dressing or covering. In an advantageous manner, the groove 14, or the covered groove 16, acts together with the groove 12 of the forme cylinder 03, 08 when the cylinders roll off on each other. In accordance with FIG. 4, the two blankets 09 on the transfer cylinder 02 can also be arranged offset by 180° in the circumferential direction in respect to each other, in which case a portion of the groove 14 and a portion of the groove 16 are respectively covered. In particular, in connection with very long cylinders, the arrangement of three or more blankets 09 placed next to each other, either aligned or alternatingly takes place in an analogous manner as shown in FIG. 9.

Figure 5:
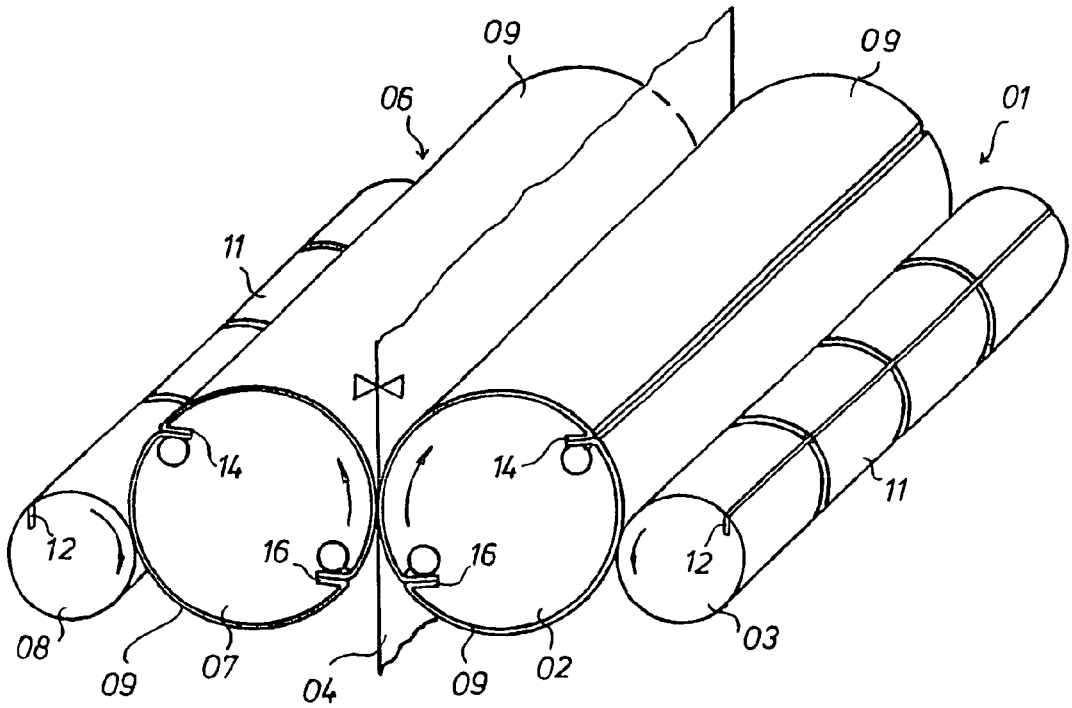

The arrangement of two blankets 09, which are arranged one behind the other in the circumferential direction of the transfer cylinders 02, 07 and each of which extends over almost the entire length of the barrel, on a transfer cylinder 02, 07, which, in respect to a newspaper page, is of double width and has a doubled circumference, is represented in FIG. 5. Four newspaper pages, arranged next to each other in the longitudinal direction of the transfer cylinder 02, 07, are transferred per blanket 09. If more than two grooves 14, 16 are arranged on the transfer cylinder 02, 07, the arrangement of a corresponding number of blankets 09, or the covering of the grooves 14, 16, is possible.

Figure 6:
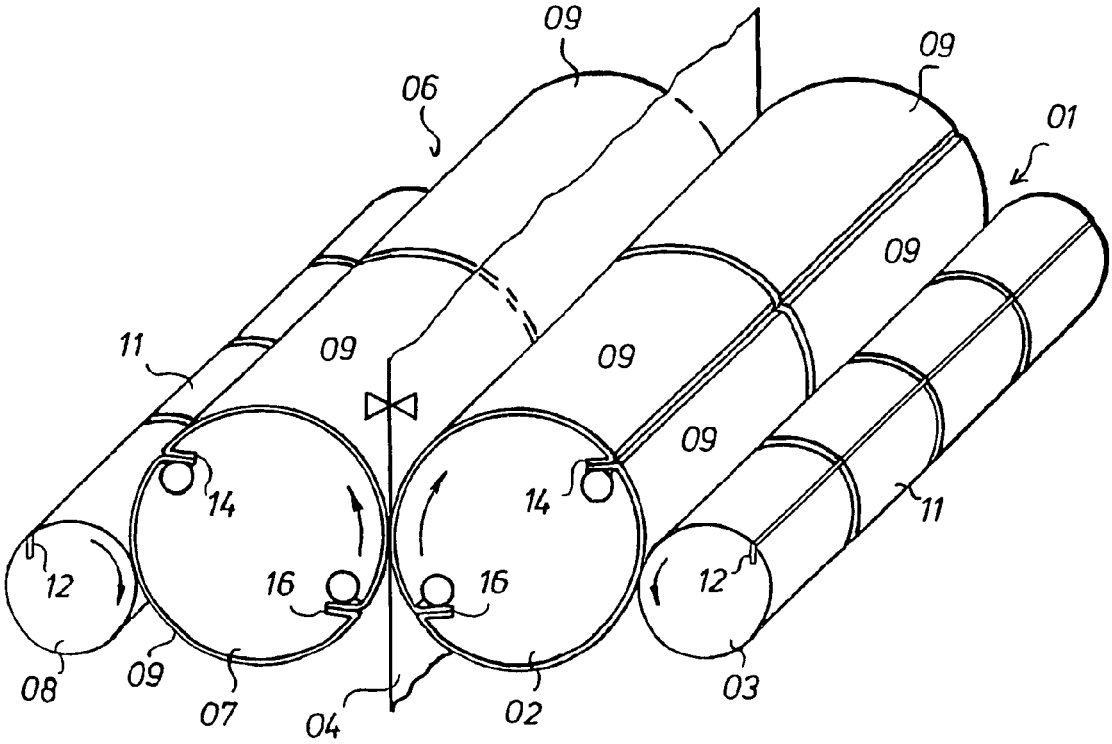

FIG. 6 shows the arrangement of four blankets 09 on a transfer cylinder. 02, 07 which is, for example, of double width and double circumferential size. Two blankets 09 are arranged behind each other in the longitudinal direction. Two additional blankets 09 are arranged next to each other in the circumferential direction. More than two blankets may be arranged in the longitudinal, or circumferential direction in an analogous manner, in particular for longer or thicker cylinders. However, such an arrangement requires a corresponding number of grooves 14, 16.

FIG. 7 shows a covering of the transfer cylinder 02, for example with four grooves 14, 16, 17, 18, with two dressings or blankets 09 arranged behind each other in the circumferential direction, wherein in this case every second groove 17, 18 is covered. This applies, in an analogous manner, analogously to the arrangement of four grooves on forme cylinders 03, 08, although this is not specifically depicted.

A respectively symmetrical arrangement of the grooves 12, 13, or 14, 16 in the circumferential direction at almost identical intermediate angles is advantageous for the transfer cylinder 02, 07, as well as for the forme cylinders 03, 08, for example with two grooves 12, 13, or 14, 16, offset by respectively 180°, with three by respectively 120°, or alternatingly offset by 180°. With more than respectively two grooves 12, 13, or 14, 16, several printing plates 11 or blankets 09, arranged next to each other in the longitudinal direction, can also be offset with respect to each other in the circumferential direction.

The ratio of the circumference of the transfer cylinders 02, 07 to that of the forme cylinders 03, 08 is advantageously a whole number. In case of a forme cylinder 03, 08 with grooves 12, 13 arranged behind each other in the circumferential direction, and with a double-size circumference, the ratio is equal to 1.

The two cylinder pairs 01 and 06 represented in FIGS. 3 to 7 and 10 do not have to be equipped in the same way with the same number of grooves or the same groove geometry, or covered in the same pattern of the dressings or coverings 09, 11. However, a matching of the phases of the non-printing areas of the transfer cylinders 02, 07 acting together with the forme cylinder 03, 08 is advantageous, so that non-printing areas, in particular areas of the covered or not covered grooves, act together if possible. The forme cylinders 03 and the transfer cylinders 02 described in FIGS. 1 to 7 and 10 can, of course, also be covered in the "conventional" way, i.e. with several dressings or coverings 09, 11, whose number is determined by the number of grooves, and which are arranged one behind the other in the circumferential direction.

The coverings of the transfer cylinder 02, 07 with blankets 09, represented in FIGS. 1 to 7 and 10, and in the associated descriptions, should also be used correspondingly for the respectively other preferred embodiments. The same applies to the covering of the forme cylinders 03, 08 and the transfer to the other preferred embodiments in connection with the various embodiments of the transfer cylinder 02, 07.

In FIGS. 1 to 7 and 10 the grooves 12, 13, 14, 16, 17, 18 are each represented as extending to the front face of the respective cylinder 02, 04, 07, 08. However, for reasons of stability, for reasons of soiling, or when using bearer rings, for example, there can be an edge at the front face without a groove 12, 13, 14, 16, 17, 18. In this case the grooves 12, 13, 14, 16, 17, 18 extend over almost the entire length of the cylinder 02, 03, 07, 08, or of its barrel.

The embodiments mentioned for the arrangement of the grooves 12, 13, 14, 16, 17, 18 and dressings or coverings 09, 11 on transfer cylinders 02, 07 and forme cylinders 03, 08, as well as configurations of print units with a cylinder pair 01, 06 consisting of a transfer cylinder 02, 07 and a forme cylinder 01, 06 acting together with it, are of course also to be employed in the case where the cylinder pair 01, 06 does not act together with a second transfer cylinder 07, but instead with a counter-pressure cylinder embodied, for example, as a steel cylinder.

Here, a dressing or cover 11 is understood to be a one-piece printing plate 11, for example. The dressing 09 for the transfer cylinder 02, 07 represents a one-piece blanket 09. This one-piece blanket 09 can be embodied in a single layer or in multiple layers, wherein for the latter at least one layer 22, for example, has been applied on a support plate 21 and is fixedly connected therewith. The ends 23, 24 of the single- or multi-layer blanket 09 act together with a holding device 26 arranged in the groove 14, 16, 17, 18, all as shown in FIG. 8.

The embodiment of the blanket 09 as a multi-layer blanket 09 which, when the forme cylinder 03 rolls off on the transfer cylinder 02, for example, does not change its length or width at all, or only negligibly, by flexing, is particularly advantageous in connection with narrow openings of the grooves 14, 16, 17, 18 extending toward the shell surface of the transfer cylinder 02, 07. For this purpose, the blanket unit 09 has, as shown in FIG. 8, the almost dimensionally fixed support plate 21, for example made of metal or plastic, on which the elastic, or soft layer 22 is applied. In the present example of the multi-layer blanket 09, the ends 23 and 24 of the blanket 09 are identical with the ends of the support plate 21, since in the area acting together with the groove 14, 16, 17, 18 the support plate 21 is bent off and without the elastic or soft layer 22.

In another embodiment, the support plate 21 of the multi-layer blanket 09 can also be provided with a layer up to the ends of the support plate 21, wherein, in this case, the ends 23 and 24 of the multi-layer blanket 09 also have the layer 21, besides the support plate 21. If the blanket is embodied as a simple rubber blanket 09, the ends 23, 24 of the rubber blanket 09 act together with the grooves 14, 16, 17, 18.

In an advantageous embodiment, the grooves 12, 13 can also have holding devices 33 for the printing formes 11, as seen in FIG. 2.

The holding device 26, 33 can be a known device for the frictionally connected or interlocked holding and/or bracing of a dressing or cover 09, 11, such as, for example, frictionally connected or interlocking mechanisms, bracing strips or shafts driven by spring force or by drive mechanisms, or tangential catches.

In FIG. 8, an advantageous embodiment of a holding device 26 for a dressing or cover 09, 11, in particular for a multi-layer blanket 09 or a printing forme 11, is shown representatively by the example of a multi-layer blanket 09 positioned in the groove 14 in the transfer cylinder 11. The arrangement of such or similar holding devices 33 for the printing formes 11 in the grooves 12, 13 is indicated by way of example in FIG. 2.

For holding the blanket 09, the holding device 26 is arranged in the axially extending groove 14 of the transfer cylinder 02, as shown in FIG. 8. The actuation of the device for bracing or holding the multi-part blanket 09 takes place by use of a shaft 27, for example a spindle 27 with pressure elements 28, with spindle 27 being rotatably seated in the groove 14 of the transfer cylinder 02.

The groove 14, extending parallel with the axis of the transfer cylinder 02 and inclined by 30 to 60°, in particular at approximately 45°, in respect to the tangent line of the shell surface, has a gap 29 on the shell surface of the transfer cylinder 02 and a bore 31, which is located in the interior of the transfer cylinder 02 and which is connected with the gap 29. The width b29 of the gap 29 in the area of the shell surface in the circumferential direction of the transfer cylinder (02, 03, 07, 08) is greater than twice the thickness of one of the ends 23, 24 of the blanket 09 which, in the present example, is equal to twice the thickness of the support plate 21. Regarding the width b29 of the gap 29, 1 mm≧b29≧5 mm, in particular b29≧3 mm, applies in an advantageous manner. In the case of a simple rubber blanket 09, the width b09 is negligibly greater than twice the thickness of the rubber blanket 09. In the case of the multi-layer blanket 09 layered up to the ends of the support plate 21, the width b29 should be selected to be negligibly greater than twice the thickness of the layered end 23, 24 of the multi-layer blanket 09.

The shaft 27, for example a pivotable spindle 27, on which the pressure elements 28, for example plungers, spheres or the like are arranged resiliently and facing outward, is arranged in the bore 31.

For bracing the blanket 09, both ends 23, 24 of the blanket 09, in the example this is the equivalent of the ends of the support plate 21, are guided into the gap 29, and the spindle 27 with the pressure elements 28 is pivoted in such a way that it presses almost vertically against the leading and trailing ends 23 and 24 of the blanket 09, or of the support plate 21 and a wall 32 fixed on the cylinder, and maintains them in a frictionally connected manner in the gap 29. If several blankets 09 are arranged one behind the other in the circumferential direction of the transfer cylinder 02, respective leading and trailing ends 23 and 24 of adjoining blankets 09 act together. The holding device 26 can additionally have a pusher, not represented, which can be pushed into the gap 29 in addition to the ends 23 and 24 and closes the gap 29 off toward the exterior. This pusher is advantageously connected with the spindle 27, so that it is moved into, or out of, the gap 29 when the spindle 27 is pivoted. When employing such a pusher, the width b29 of the gap 29 is designed to be appropriately wider.

In a preferred embodiment, the grooves 12, 13 of the forme cylinders 03, 08 are also embodied, as in connection with the grooves 14, 16, 17, 18, as narrow gaps 12, 13, which are inclined by 30 to 60°, in particular by approximately 45°, in respect to the tangent line of the shell surface and have a width b12 as shown in FIGS. 1, 2, in the area of the shell surface in the circumferential direction which is greater than twice the thickness of the printing forme 11. Regarding the width b12 of the gap 12, 1 mm≧b12≧5 mm, in particular b12≧3 mm, applies in an advantageous manner. For a basic representation of the holding device 33 for the printing forme 11, it is merely necessary in FIG. 8, which represents the multi-part blanket 09, to replace the multi-part blanket 09, made of a support plate 21 and layer 22, by a printing forme 11 with bent-off ends extending into the groove 12, 13. The reference symbol for the width b29 would correspond to the width b12, and the reference symbol for the transfer cylinder 02 would correspond to that of the forme cylinder, for example 03. The ends 23, 24 would correspond to the bent-off ends of the printing forme 11.

It is possible to do without a holding device 33 in the grooves 12, 13 of the forme cylinders 03, 08 if secure seating is assured by appropriate shaping of the ends of the printing forme 11 and/or the grooves 12, 13.

While preferred embodiments of a printing group of a rotary printing press in accordance with the present invention have been set forth fully and completely hereinabove, it will be apparent to one of skill in the art that a number of changes in, for example the overall configuration of the printing press, the type of material being printed, and the like could be made without departing from the true spirit and scope of the present invention which is accordingly to be limited only by the following claims.

What is claimed is:

1. A printing group of a rotary printing press comprising:

a transfer cylinder, said transfer cylinder having a transfer cylinder barrel with a transfer cylinder barrel circumference of twice the length of a newspaper page and with a transfer cylinder barrel axial width;

a forme cylinder working together with said transfer cylinder and forming a cylinder pair in cooperation with said transfer cylinder, said forme cylinder having a forme cylinder barrel with a forme cylinder barrel circumference and with a forme cylinder barrel axial width;

a continuous longitudinal groove in said transfer cylinder and extending axially over said entire transfer cylinder barrel width, said continuous longitudinal groove having a gap with a gap width of between 1 mm and 5 mm;

two printing blankets on said transfer cylinder barrel, said at least two printing blankets being arranged axially aligned side by side on said transfer cylinder barrel, each of said printing blankets being a multi-layered blanket and including an underlying dimensionally stable support plate and a resilient upper layer permanently connected to said support plate, each of said at least two printing blankets having a length of said transfer cylinder barrel circumference; and first and second forme cylinder grooves in said forme cylinder barrel, said first and second forme cylinder grooves being offset in a circumferential direction of said forme cylinder barrel by 180°, at least one of said forme cylinder grooves extending along said entire axial width of said barrel of said forme cylinder.

2. The printing group of claim 1 wherein both of said first and second forme cylinder grooves extend over said entire width of said forme cylinder barrel.

3. The printing group of claim 1 wherein said forme cylinder circumference is equal to said transfer cylinder circumference.

4. The printing group of claim 1 wherein said transfer cylinder has said barrel width of at least four newspaper pages.

5. The printing group of claim 1 wherein said transfer cylinder continuous longitudinal groove has a width greater than twice a thickness of an end of each said printing blanket and no greater than 3 mm.

6. The printing group of claim 1 wherein said resilient upper layer which is permanently connected to said support plate is a rubber layer.

7. The printing group of claim 1 wherein a ratio of said circumference of said transfer cylinder barrel to a circumference of said forme cylinder is a whole number.

8. The printing group of claim 1 further including at least first and second printing formes on said forme cylinder, said at least first and second printing formes including ends, said printing forme ends being aligned axially along said forme cylinder barrel axial width.

9. The printing group of claim 1 further including a plurality of printing formes arranged on said forme cylinder barrel one behind the other in said circumferential direction of said forme cylinder barrel.

10. The printing group of claim 1 wherein said forme cylinder barrel has a circumferential length corresponding to at least two newspaper pages.

11. The printing group of claim 1 wherein said transfer cylinder barrel width corresponds to at least six newspaper pages.

12. The printing group of claim 1 wherein said first and second forme cylinder grooves each have a width greater than twice the thickness of a printing forme and between 1 and 5 mm.

13. The printing group of claim 12 wherein said width is no greater than 3mm.

14. The printing group of claim 1 further including a holding device in each said groove.

15. The printing group of claim 1 further including a counter-pressure cylinder working together with said transfer cylinder.

* * * * *